US006876152B2

(12) United States Patent
Jeon et al.

(10) Patent No.: US 6,876,152 B2
(45) Date of Patent: Apr. 5, 2005

(54) COOLING APPARATUS OF PLASMA LIGHTING SYSTEM

(75) Inventors: Yong-Seog Jeon, Gwangmyung (KR); Joon-Sik Choi, Seoul (KR); Hyun-Jung Kim, Seoul (KR); Hyo-Sik Jeon, Gwangmyung (KR); Ji-Young Lee, Gwangmyung (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/452,579

(22) Filed: Jun. 3, 2003

(65) Prior Publication Data

US 2004/0113559 A1 Jun. 17, 2004

(30) Foreign Application Priority Data

Dec. 17, 2002 (KR) ..... 10-2002-0080866

(51) Int. Cl.[7] ..... H01J 25/50; H01J 7/26

(52) U.S. Cl. ..... 315/39.51; 315/39.71; 315/112; 315/248; 313/24

(58) Field of Search ..... 313/24; 315/112, 315/248, 39.51, 39.71, 344, 118, 114, 244, 39

(56) References Cited

U.S. PATENT DOCUMENTS

| | | | | |
|---|---|---|---|---|
| 6,680,576 | B2 * | 1/2004 | Jeon | 315/112 |
| 6,717,365 | B2 * | 4/2004 | Lee et al. | 315/39.51 |
| 6,774,571 | B2 * | 8/2004 | Choi et al. | 315/112 |
| 2002/0030453 | A1 * | 3/2002 | Kirkpatrick et al. | 315/248 |
| 2003/0057842 | A1 * | 3/2003 | Kim et al. | 315/39 |
| 2003/0160553 | A1 * | 8/2003 | Seo | 313/24 |

* cited by examiner

*Primary Examiner*—Thuy Vinh Tran
*Assistant Examiner*—Chuc Tran
(74) *Attorney, Agent, or Firm*—Birch, Stewart, Kolasch & Birch, LLP

(57) ABSTRACT

A cooling apparatus of a plasma lighting system. The system includes a power supply for supplying a power source; a magnetron for generating electromagnetic wave by the power source from the power supply; a bulb for generating light in accordance with that inert gas is ionized by the electromagnetic wave; and a case unit of a hermetic shape including the magnetron and the power supply therein for cooling heat generated from the magnetron. The plasma lighting system prevents heat of high temperature generated from the magnetron from being transmitted and foreign substance from being introduced.

15 Claims, 7 Drawing Sheets

COOLING APPARATUS OF PLASMA LIGHTING SYSTEM

This nonprovisional application claims priority under 35 U.S.C. § 119(a) on Patent Application No(s). 10-2002-0080866 filed in KOREA on Dec. 17, 2002, which is(are) herein incorporated by reference.

BACKGROUND OF THE INVENTION

1. Field of the Invention

The present invention relates to a plasma lighting system, and more particularly, to an eco-friendly cooling apparatus of a plasma lighting system which can prevent components therein from being damaged by shielding foreign substances at the time of installing the plasma lighting system outdoors, and prevent noise at the time of installing it indoors.

2. Description of the Related Art

Generally, a plasma lighting system provides high economical efficiency and an idealistic natural light than any other conventional lamps.

A light emitting principle of the plasma lighting system will be explained. First, microwave (high frequency) generated from a magnetron of a high frequency oscillator makes inert gas in a bulb into plasma, which is ionized status.

The above plasma status is maintained to make metal compound in the bulb emit light continuously, thereby proving high quantity of light without an electrode.

The plasma lighting system has following advantages.

Luminous flux corresponding to that of four metal halide lighting system of 400 W can be generated by one plasma lighting system, energy consumption can be reduced by 20% or more, and an additional stabilizer is not needed since a built-in stabilizer is used.

Also, since light is emitted by the light emitting principle of the plasma without a filament, the apparatus can be used for a long time without lowering the flux.

Also, since continuous optical spectrum same as the natural white-light is realized, the plasma lighting system functions similarly to the sun light. The plasma lighting system is useful where the sun light is not streamed into or where color discrimination is made.

The apparatus does not use fluorescent material to protect visual acuity, and is able to minimize radiation of ultraviolet ray and infrared ray to provide comfortable and eco-friendly lighting environment.

Hereinafter, constructions of the conventional plasma lighting system will be explained.

FIG. 1 is a longitudinal cross-sectional view showing an entire construction of a plasma lighting system in accordance with the conventional art.

As shown in FIG. 1, the conventional plasma lighting system comprises: a magnetron 20 installed at and upper end of one side of a casing 10 for generating electromagnetic wave; a power supply 30 installed at an upper end of another side of the casing 10 with an opposite state to the magnetron 20 for supplying AC power to the magnetron 20 by boosting into a high voltage; a wave guide 40 connected to an outlet of the magnetron 20 and installed between the magnetron 20 and the power supply 30 for transmitting the electromagnetic wave generated from the magnetron 20 to a bulb; a bulb 50 connected to a middle upper portion of the wave guide 40 and provided with light emitting material, buffer gas, and discharge catalyst material therein for generating light by making the filled fluorescent material into plasma by the electromagnetic wave energy; a resonator 60 including the bulb 50 and passing light generated from the bulb 50 while blocking the electromagnetic wave transmitted from the wave guide 40; reflectors 70 attached to a middle upper portion of the casing 10 for containing the resonator and thus intensively reflecting the light generated from the bulb 50; a dielectric mirror 80 attached to rear both sides of the bulb 50 and to an inner side of the resonator 60 for passing electromagnetic wave and reflecting light; and a cooling fan assembly 90 installed at a lower side of the casing 10 for cooling the magnetron 20 and the power supply 30.

The casing 10 is divided into an upper case 11 and a lower case 12. An electromagnetic wave passing hole 11*a* for inducing electromagnetic wave by connecting the wave guide 40 and the resonator 60 is formed at a center of the upper case 11, and air exhaustion holes 11*b* for exhausting air sucked into the casing 10 from outside to the outside by the cooling fan assembly 90 which will be later explained are formed at right and left sides of the electromagnetic wave passing hole 11*a*.

Also, an air suction hole 12*a* is formed at a middle lower portion of the lower case 12, and air suction passages 12*b* separated right and left by being connected to the air suction hole 12*a* are formed. A fan 92 which will be later explained is installed at a center of the air suction passages 12*b*.

In the meantime, the magnetron 20 and the power supply 30 are located between the air suction passages 12*b* and the air exhaustion holes 11*b* so as to correspond to both outlets of the air suction passages 12*b*, and thus fixed to both sides of the wave guide 40, respectively.

The wave guide 40 is formed as a ring type, and a magnetron insertion hole 41 is formed to be connected to the magnetron 20 at a peripheral wall of one side, and an electromagnetic wave guide hole 42 having a closed lower end and an opened upper end is formed to be connected to the electromagnetic wave passing hole 11*a* of the upper case 11.

The bulb 50 is composed of a light emitting portion 51 formed as a sphere shape by using quartz, a light transmitting substance, so that buffer gas, light emitting material, and discharge catalyst material can be filled therein; and a shaft portion 52 integrally formed at a center of a lower side of the light emitting portion 51 and engaged to a rotation shaft of a bulb motor M.

Also, the cooling fan assembly 90 is composed of a fan motor 91 fixed to a center of the casing 10; and a blower 92 engaged to a rotation shaft of the fan motor 91 to be rotated together and installed at the air suction passage 12*b* of the lower case 12 for sucking air outside of the casing 10 into the casing.

Operations of the conventional plasma lighting system are as follows.

First, if a driving signal is inputted to the power supply 30 by a controlling unit, the power supply 30 boosts AC power and then supplies the boosted high voltage to the magnetron 20. The magnetron 20 is oscillated by the high voltage and generates electromagnetic wave having high frequency. The generated electromagnetic wave is emitted into the oscillator 60 through the wave guide 40 and discharges the material in the bulb 50, thereby generating light having a peculiar emitting spectrum. The light is reflected forward by the reflector 70 and the dielectric mirror 80, thereby lightening a space.

At this time, heat of high temperature is generated from the magnetron 20 and the power supply 30. Especially, in the magnetron 20, some high frequency energy which is not emitted among the high frequency energy generated by heat electron disappears by heat, thereby enhancing inner temperature of the casing 10. According to this, the fan 92 is operated, and as shown in FIG. 1, cool air of outside is sucked into the casing 10 to cool heat generated from the magnetron 20.

However, in the conventional lighting system, an inner part of the casing is formed as a single space, thereby having a difficulty in emitting heat. Also, heat of high temperature generated from the magnetron is transmitted to the power supply to destroy inner components thereof, thereby degrading efficiency and life span of the plasma lighting system.

Also, in the conventional plasma lighting system, air-cooling using the fan is used in order to cool heat generated from the magnetron. In this case, rain water or foreign substance is introduced into an air inlet and an outlet at the time of installing the plasma lighting system outdoors to damage the inner components, and at the time of installing it at the interior, noise generated from the fan caused inconvenience.

SUMMARY OF THE INVENTION

Therefore, an object of the present invention is to provide a cooling apparatus of a plasma lighting system which can prevent rain water or foreign substance from being introduced at the time of installing the plasma lighting system outdoors, remove noise due to a cooling fan at the time of installing it indoors, and prevent heat generated from the magnetron from being transmitted to the power supply in order to prevent the power supply from being damaged.

To achieve these and other advantages and in accordance with the purpose of the present invention, as embodied and broadly described herein, there is provided a cooling apparatus of a plasma lighting system comprising: a power supply for supplying a power source; a magnetron for generating electromagnetic wave by the power source from the power supply; a bulb for generating light in accordance with that inert gas is ionized by the electromagnetic wave; and a case unit having a hermetic space including the magnetron and the power supply therein for cooling heat generated from the magnetron.

The case unit is composed of a first case installed at an outer side of the magnetron; and a second case hermetically engaged to the first case at an outer side of the power supply.

The first and second cases are provided with a plurality of heat discharging fins for cooling heat generated from the magnetron at outer surfaces thereof.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a cooling apparatus of a plasma lighting system will be explained with reference to attached drawings.

Even if the cooling apparatus of the plasma lighting system has many preferred embodiments, the most preferred embodiment will be explained.

Figure 1:
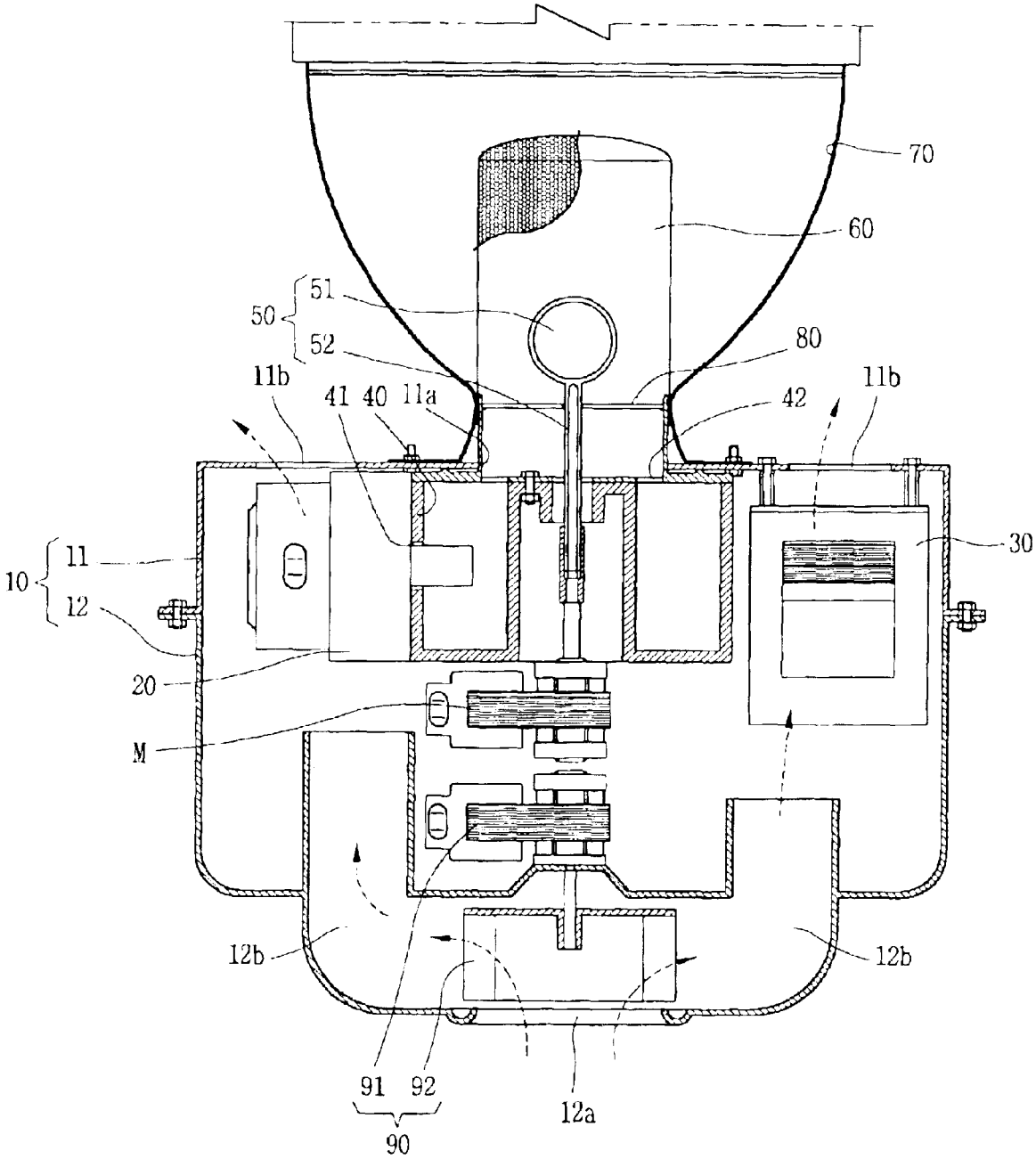
FIG. 1 PRIOR ART
FIG. 1 is a longitudinal cross-section view showing an entire construction of a plasma lighting system in accordance with the conventional art.
Figure 2:
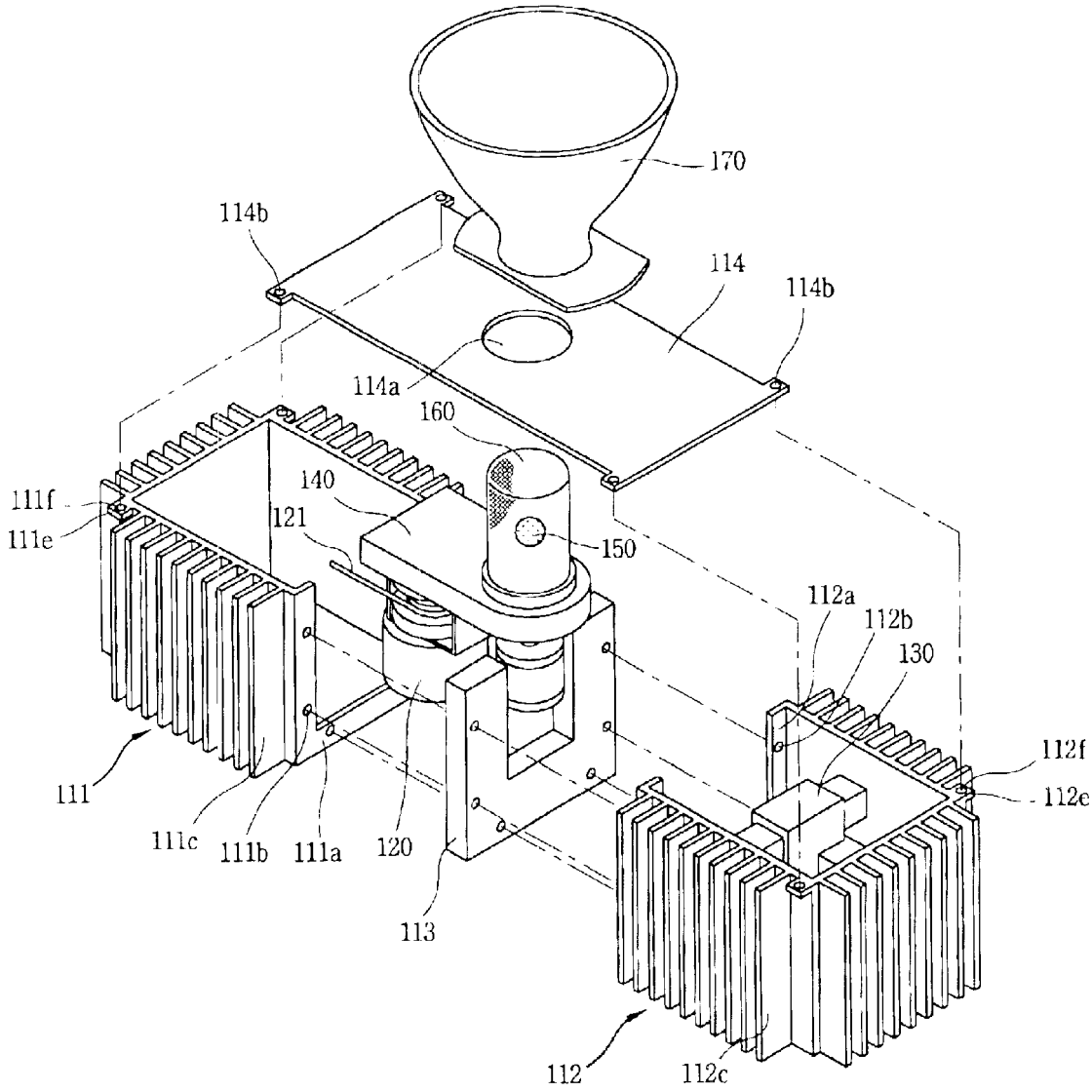
FIG. 2 is a disassembled perspective view showing a cooling apparatus of a plasma lighting system according to the present invention.
Figure 3:
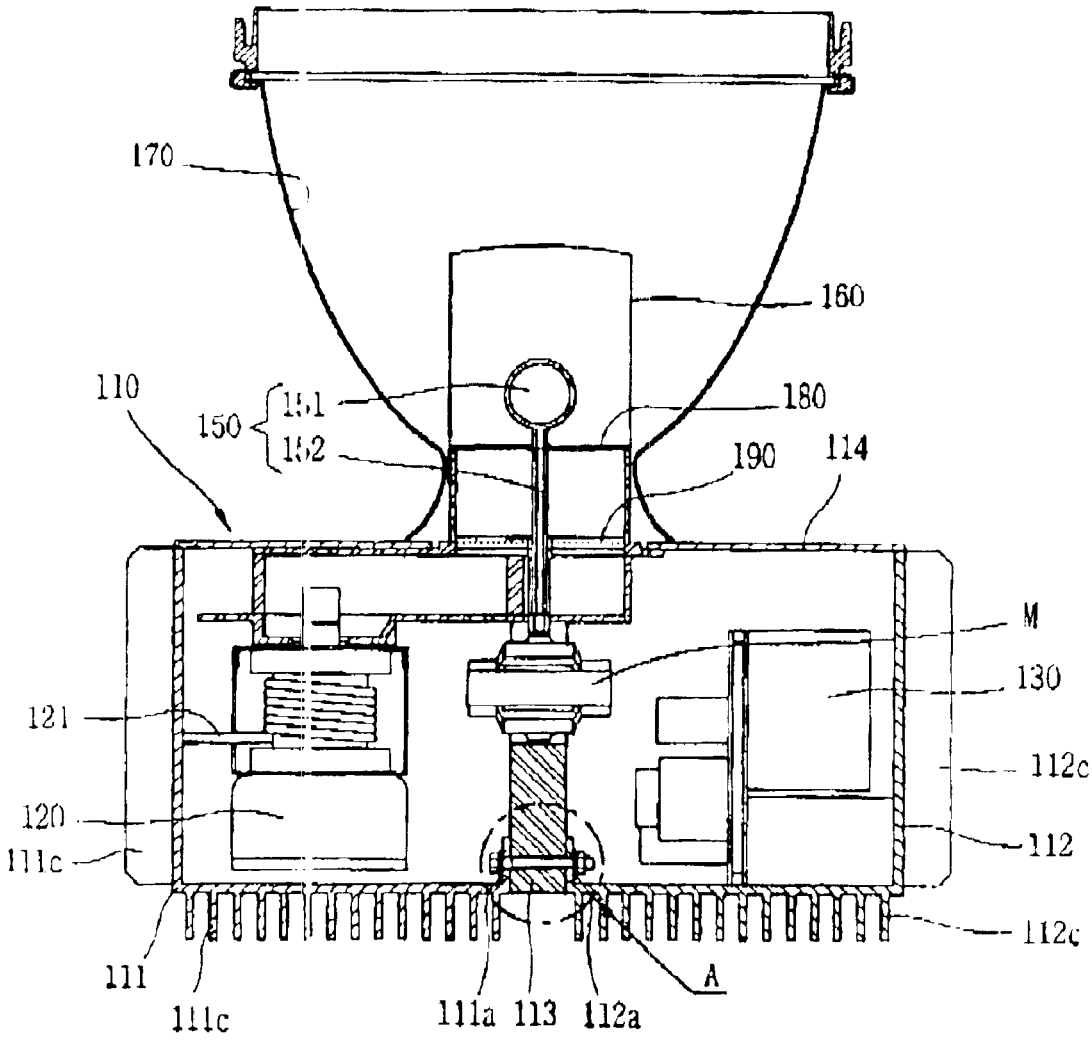
FIG. 3 is a longitudinal cross-section view showing a state that a cooling apparatus of a plasma lighting system according to the present invention is assembled.
Figure 4:
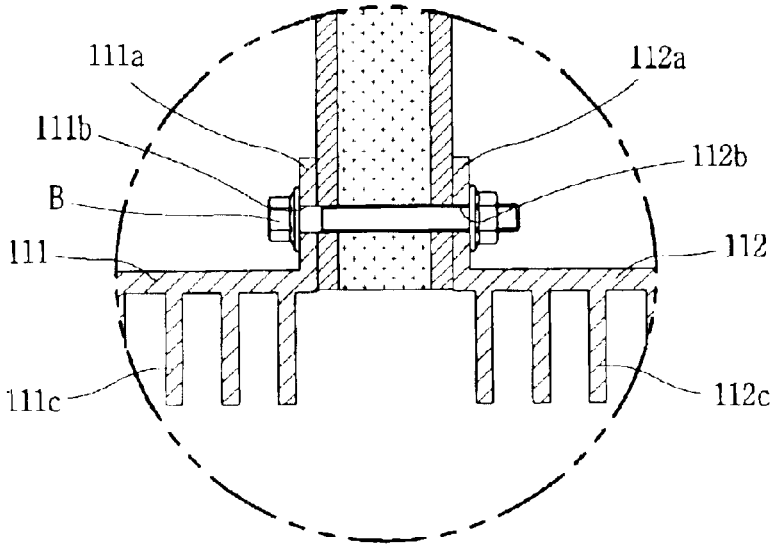
FIG. 4 is an enlarged view of"A" part of FIG. 3, which shows a first embodiment that a case rib is bent towards an inner side of first and second cases and engaged to an adiabatic member.
Figure 5:
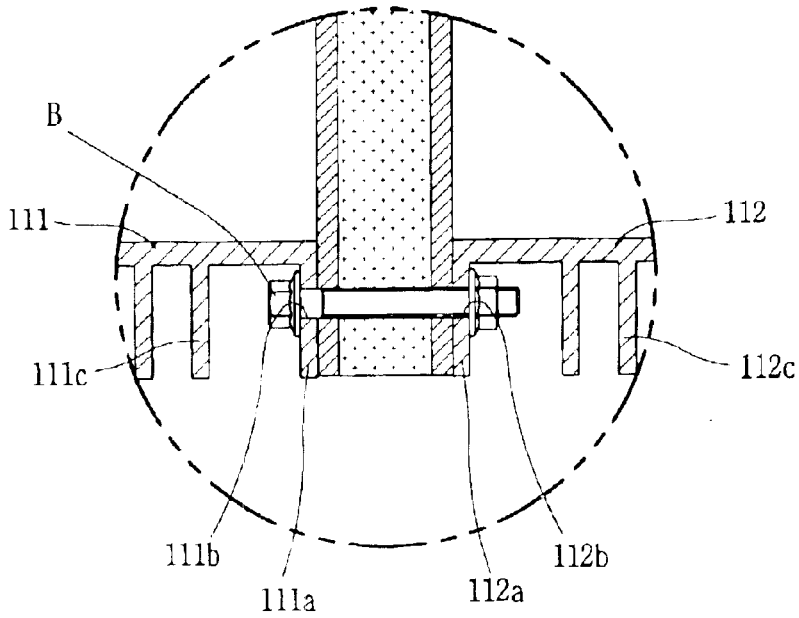
FIG. 5 is an enlarged view of"A" part of FIG. 3, which shows a second embodiment that the case rib is bent towards an outer side of the first and second cases and engaged to the adiabatic member.
Figure 6:
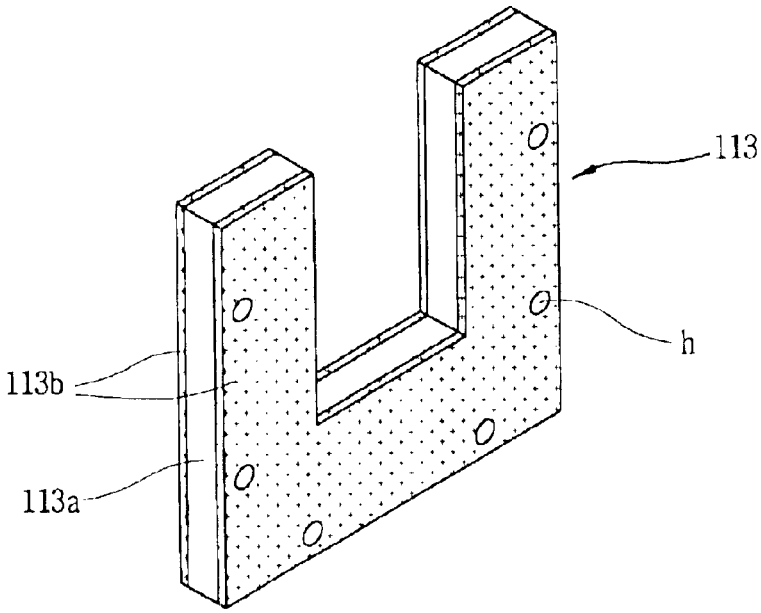
FIG. 6 is a perspective view showing the first embodiment in which a sealing material is attached to both front surfaces of the adiabatic member according to the present invention.
Figure 7:
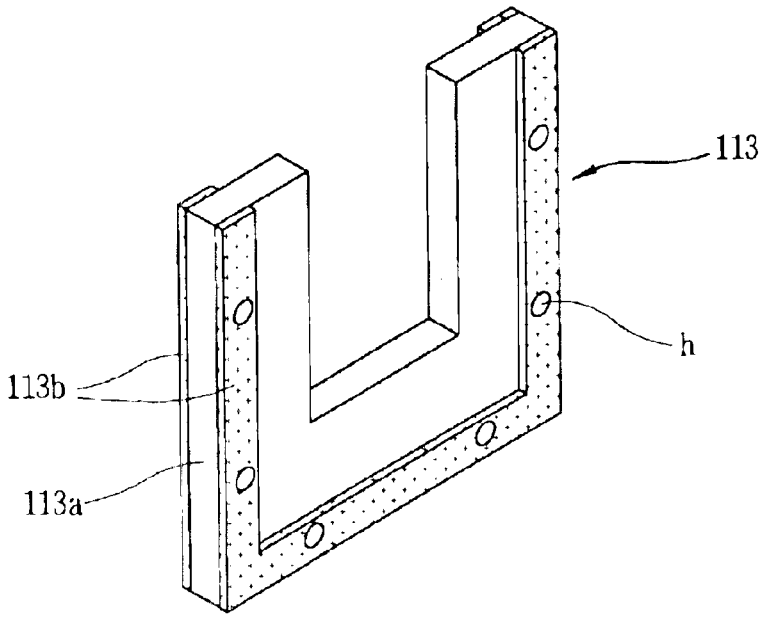
FIG. 7 is a perspective view showing the second embodiment in which the sealing material is attached to edges of the adiabatic member contacted to the first and second cases.
Figure 8:
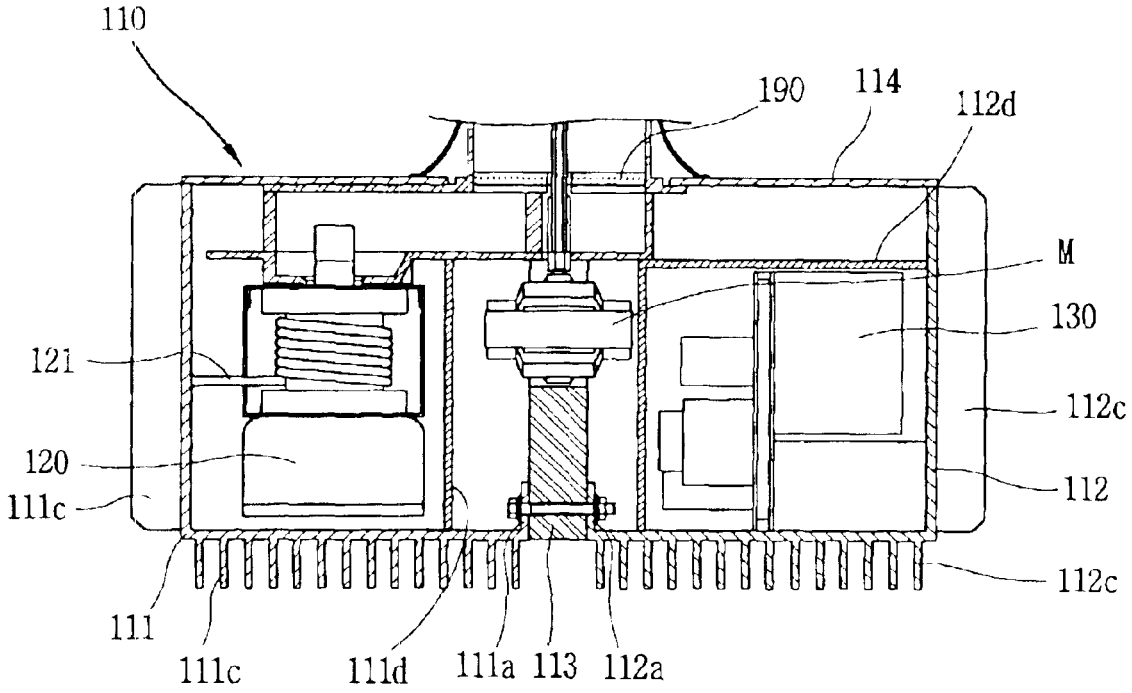
FIG. 8 is a longitudinal cross-section view showing an inner part of a case in the cooling apparatus of the plasma lighting system.
Figure 9:
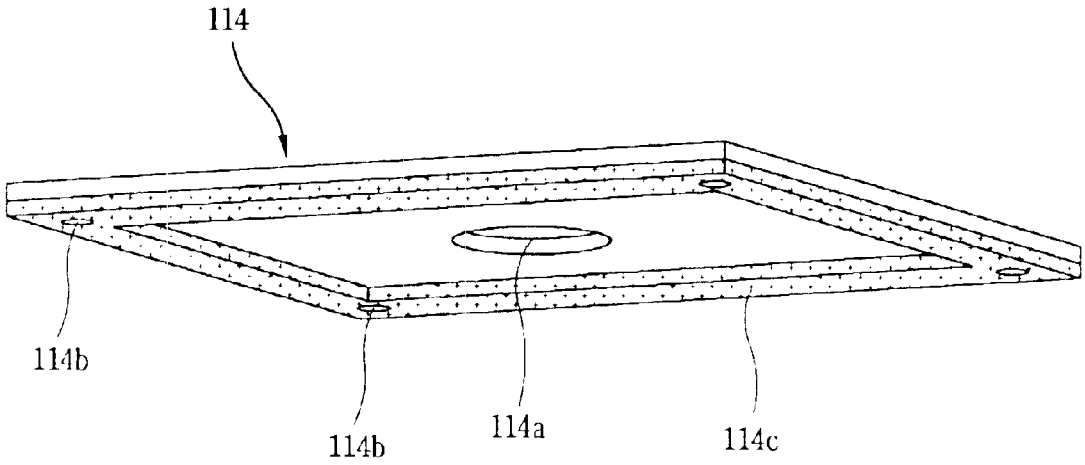
FIG. 9 is a backside perspective view showing a cover of the cooling apparatus of the plasma lighting system according to the present invention.
Figure 10:
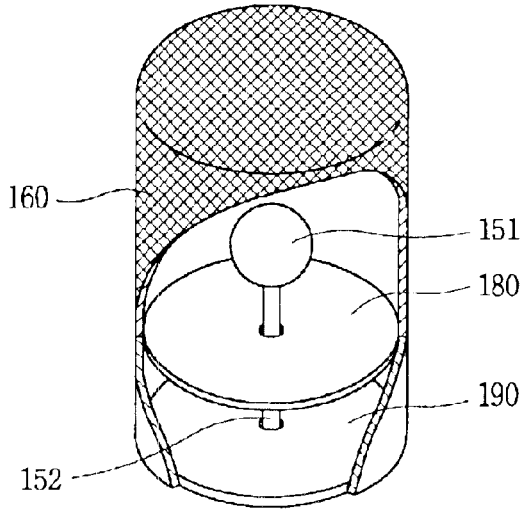
FIG. 10 is a perspective view showing an inner part of a resonator of the cooling apparatus of the plasma lighting system according to the present invention.

FIG. 2 is a disassembled perspective view showing the cooling apparatus of a plasma lighting system according to the present invention, FIG. 3 is a longitudinal cross-section view showing a state that a cooling apparatus of a plasma lighting system according to the present invention is assembled, FIG. 4 is an enlarged view of"A" part of FIG. 3, which shows a first embodiment that a case rib is bent towards an inner side of first and second cases and engaged to an adiabatic member, FIG. 5 is an enlarged view of"A" part of FIG. 3, which shows a second embodiment that the case rib is bent towards an outer side of the first and second cases and engaged to the adiabatic member, FIG. 6 is a perspective view showing the first embodiment in which a sealing material is attached to both front surfaces of the adiabatic member according to the present invention, FIG. 7 is a perspective view showing the second embodiment in which the sealing material is attached to edges of the adiabatic member contacted to the first and second cases, FIG. 8 is a longitudinal cross-section view showing an inner part of a case in the cooling apparatus of the plasma lighting system, FIG. 9 is a backside perspective view showing a cover of the cooling apparatus of the plasma lighting system according to the present invention, and FIG. 10 is a perspective view showing an inner part of a resonator of the cooling apparatus of the plasma lighting system according to the present invention.

The cooling apparatus of a plasma lighting system, as shown in FIG. 2, comprises: a case unit 110 having a plurality of receiving spaces; a magnetron 120 installed at an inner part of one side of the casing unit 110 for generating electromagnetic wave; a power supply 130 installed at an inner part of another side of the case unit 110 for supplying AC power to the magnetron 120 by boosting into a high voltage; a wave guide 140 connected to an outlet of the magnetron 120 for transmitting the electromagnetic wave generated from the magnetron 120; a bulb 150 installed at an upper portion of one side of the wave guide 140 for generating light by exciting the filled material and making into plasma by the electromagnetic wave energy; a resonator 160 located at a front side of the wave guide 140 by covering the bulb 150 for shielding the electromagnetic wave and passing light; reflectors 170 for containing the resonator 160 and thus intensively reflecting the light generated from the bulb 150.

As shown in FIGS. 2 and 3, the case unit 110 includes: a first case 111 having a predetermined inner space so as to receive the magnetron 120 for opening one lateral surface and an upper surface thereof; a second case 112 having a predetermined inner space so as to receive the power supply 130 for opening one lateral surface and an upper surface opposite to the first case 111; an adiabatic member 113 located between the first case 111 and the second case 112 for insulating the first and second cases 111 and 112; and a cover 114 for covering upper surfaces of the first case 111 and the second case 112.

Also, as shown in FIG. 4, the first case 111 is formed of a metal having a high heat conductivity such as aluminum as a square box shape, and a case rib 111*a* bent inwardly is formed at one surface contacted to one surface of the adiabatic member 113.

Also, an engaging hole 111*b* for bolt-engaging the case rib 111*a* of the first case 111 to a case rib 112*a* of the second case 112 is formed at a center of the case rib 111*a*.

Also, a plurality of heat discharging fins 111*c* for emitting heat generated from the magnetron is formed at an outer surface of the first case 111 by die casting or extrusion.

As shown in FIG. 8, a heat transfer preventing plate 111*d* of plastic material is formed at an inner space of the first case 111 so as to mount and then seal the magnetron 120.

As shown in FIG. 4, the second case 112 is formed of a metal having a high conductivity such as aluminum by the same method as that of the first case 111, and a case rib 112*a* having an engaging hole 112*b* is formed to be opposite to the case rib 111*a* of the first case 111 at one surface contacted to another surface of the adiabatic member 113.

Also, a plurality of heat discharging fins 112*c* for emitting heat generated from the magnetron is formed at an outer surface of the second case 112 by die casting or extrusion like the first case 111.

A heat transfer preventing frame 112*d* of plastic material is formed at an inner space of the second case 112 so as to mount and then seal the power supply 130 like the first case 111.

As shown in FIGS. 4 and 5, there are a first embodiment in which the first case 111 and the second case 112 are engaged at the inside as aforementioned, and a second embodiment in which the first case 111 and the second case 112 are engaged at the outside so as to easily engage them.

To this end, as shown in FIG. 5, the case ribs 111*a* and 112*a* curved and extended respectively outwardly at opposite surfaces of the first case 111 and the second case 112 are formed, and engaging holes 111*b* and 112*b* are respectively formed at centers of the case ribs 111*a* and 112*a*.

The adiabatic member 113 is formed as a plate shape of which an upper portion is constantly dented since the bulb motor M or the wave guide 140 is located at the center thereof.

Also, the adiabatic member 113 includes an adiabatic plate 113*a* having a low heat conductivity and a constant intensity at the center thereof, and a sealing plate 113*b* of rubber attached to both sides of the adiabatic plate 113*a* for closely being attached to the first case 111 and the second case 112.

In the meantime, there is a first embodiment in which the sealing plate 113*b* is formed with the same shape as that of the adiabatic plate 113*a* as shown in FIG. 6, and there is a second embodiment in which the sealing plate 113*b* covers only parts where the adiabatic plate 113*a* is contacted to the first case 111 and the second case 112.

Also, a plurality of through holes h are formed on the adiabatic plate 113*a* and the sealing plate 113*b* in order to pass an engaging bolt B by opposing to the engaging holes 111*b* and 112*b* of the case ribs 111*a* and 112*a*.

The cover 114 is formed by forming metal such as aluminum as a square plate shape so as to have at least the same plane area as that of the first case 111 and the second case 112.

A plurality of heat discharging fins can be formed at an outer surface of the cover 114, and an electromagnetic wave inducing hole 114*a* is formed at the center of the cover 114 so as to connect the wave guide 140 and the resonator 160.

Also, the cover 114 is last assembled in assembly of the case unit 110, thereby being engaged at outside the respective cases 111 and 112.

To this end, cover ribs 111*e* and 112*e* having engaging holes 111*f* and 112*f* at the center thereof are formed around edges of upper surfaces of the cases 111 and 112 by being bent outwardly, and through holes 114*b* are also formed around edges of the cover 114 to correspond to the engaging holes 111*f* and 112*f* of the cover ribs 111*e* and 112*e* by the engaging bolts.

Also, as shown in FIG. 9, an adiabatic material 114*c* is attached to the edge of the cover 114 in order to shield heat conductivity between the first case 111 and the second case 112.

In the meantime, the first case 111, the second case 112, and the cover 114 can be formed by the same material having a high heat conductivity, and can be formed by different material one another.

As shown in FIG. 8, the magnetron 120 provided with an anode, a cathode, and a magnet generates electromagnetic wave so that fluorescent material of the bulb can emit light when a current is applied to the cathode.

A heat transferring material 121 having a high heat conductivity such as aluminum or copper is coiled or attached to an outer circumference surface of the cathode, and another end of the heat transferring material 121 is fixed to an inner surface of the first case 111.

Also, soldering or thermal bond is used at a contact portion between the heat transferring material 121 and the magnetron 120 in order to enhance heat conductivity.

An outer circumference surface of the power supply 130 can be fixed to an inner surface of the second case 112 by the heat transferring material.

The wave guide 140 is formed as a rectangular shape of which right and left edges are shorter than upper and lower edges, and installed at a side of the first case 111. One side of the wave guide 140 is inserted and connected to an outlet of the magnetron 120, and the other side thereof is connected to an opening of the resonator 160.

Also, the bulb 150 includes: a light emitting portion 151 formed as a sphere using quartz, that is, light-transmitting material, and located in the resonator 160 by being filled with buffer gas, luminescent material and discharging catalyst material therein; and a shaft portion 152 formed integrally on lower center portion of the light emitting portion 151 and engaged to a rotary shaft of the bulb motor M installed in the case 110.

Also, the bulb motor M is located between the magnetron 120 and the power supply 130 and installed at a groove of the adiabatic member 113. The bulb motor M is formed as a ball bearing type having a heat resistance, and formed as an enamel coil type which can endure at temperature more than 150°.

The resonator 160 of a cylindrical shape has an upper surface closed by net and an opened lower surface connected to the outlet of the wave guide 140.

Also, as shown in FIG. 10, a dielectric mirror 180 is installed between the wave guide 140 and the light emitting portion 151 of the bulb 150 for transmitting electromagnetic wave and reflecting light forward, and a bulb heat shielding plate 190 of dielectric is installed between the dielectric mirror 180 and the wave guide 140 so as to prevent heat generated from the light emitting portion 151 from penetrating into the case unit 110.

The bulb heat shielding plate 190 is formed of quartz or alumina.

The cooling apparatus of plasma lighting system according to the present invention is assembled as follows and the following effects.

First, as shown in FIGS. 2 to 8, the magnetron 120 is mounted at the first case 111 and the wave guide 140 is connected to the outlet of the magnetron 120. In this state, the outlet of the wave guide 140 is connected to a lower end of the resonator 160 and the magnetron 120 is hermetically engaged by the heat transfer preventing plate 111*d* formed of plastic and etc.

Then, in a state that the power supply 130 is mounted at the second case 112, the power supply 130 is sealed by the heat transfer preventing frame 112*d*. Next, by locating the adiabatic member 113 between the first case 111 and the second case 112, the case ribs 111*a* and 112*a* of the first and second cases 111 and 112 are coupled to each other by using an engaging bolt B and an engaging nut (not shown).

Subsequently, the wave guide 140 is engaged to the magnetron 120, and the bulb 150 to which the bulb motor M is engaged is located at the center portion of the adiabatic member 113. Next, opened upper portions of the first and second cases 111 and 112 are covered by the cover 114 and are coupled to the cover ribs 111*e* and 112*e* by the engaging bolt and the engaging nut, thereby completing an assembly of the case unit 110.

In the assembled cooling apparatus of plasma lighting system, electromagnetic wave generated from the magnetron 120 is emitted to inside of the resonator 160 through the wave guide 140, and the material filled in the bulb 150 is discharged by the electromagnetic wave, thereby generating light having its own emitting spectrum. The light is reflected forward by the reflectors 170 and the dielectric mirror 180 and illuminates a space.

At this time, heat is generated between the magnetron 120 and the power supply 130. However, the heat is divided into a high temperature portion (inside of the first case) and a low temperature portion (inside of the second case) since the first case 111 and the second case 112 is divided by the adiabatic member 113. The divided heat passes through the heat discharging fins 111*c* and 112*c* and discharged outwardly.

Especially, in accordance with that heat of high temperature of the magnetron 120 is transmitted towards the power supply 130, various inner devices of the power supply which have low heat resistance can be damaged by the heat. However, by locating the adiabatic plate 113*a* of stainless having a low heat conductivity and a constant intensity between the first case 111 and the second case 112, the heat generated from the magnetron 120 is prevented from being transmitted to the power supply 130. According to this, overheat of the power supply 130 can be prevented.

Also, by connecting the magnetron 120 to the first case 111 by the heat transfer material 121 such as a heat pipe or an aluminum bar, heat generated from the magnetron 120 can be fast discharged outwardly through the first case 111.

Besides, since the bulb heat shielding plate 190 of dielectric is provided between the bulb 150 and the wave guide 140, heat generated from the light emitting portion of the bulb 150 can be prevented from being transmitted to inside of the case 110.

Also, when the first case 111 and the second case 112 are engaged to each other, the cover 114 is formed integrally and thus temperature of the high temperature portion can be transmitted to the low temperature portion through the cover 114. However, by attaching the adiabatic material 114*c* to the contact surface between the cover 114 and the cases 111/112, heat conductivity from the high temperature portion to the low temperature portion can be prevented.

The cooling apparatus of plasma lighting system according to the present invention is divided into the first case and the second case, and the adiabatic member is installed therebetween. According to this, heat of high temperature generated from the magnetron mounted in the first case is transmitted to the power supply mounted in the second case with the minimum, and the heat is discharged to the heat discharging fin of the case, thereby preventing overheat of the power supply without a cooling fan. Also, since an inlet and an outlet of air do not exist, inflow of foreign substances is prevented at the time of installing the lighting system outdoors and noise of the cooling fan can be removed at the time of installing the lighting system indoors.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit having a hermetic space, including a first case for receiving the magnetron and a second case for receiving the power supply, wherein the first case and the second case are provided with a plurality of heat discharging fins at outer surfaces thereof.

2. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit, having a hermetic space including the magnetron and the power supply therein for cooling heat generated from the magnetron, the case unit being composed of a first case installed at an outer side of the magnetron and a second case which is hermetically engaged to the first case at an outer side of the power supply, wherein the first case is provided with a heat transfer preventing plate therein, the heat transfer preventing plate located between the magnetron and the power supply, attached to a lower surface of a wave guide, and connected to a lower surface of the first case.

3. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit, having a hermetic space including the magnetron and the power supply therein for cooling heat generated from the magnetron, the case unit being composed of a first case installed at an outer side of the magnetron, and a second case which is hermetically engaged to the first case at an outer side of the power supply wherein a heat transferring material having one side which covers the magnetron and the other side attached to an inner wall of the first case is formed between the magnetron and the first case for cooling the magnetron.

4. The apparatus of claim 3, wherein the heat transferring material is formed as a bar shape by aluminum or copper so as to transmit heat smoothly.

5. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit, having a hermetic space including the magnetron and the power supply therein for cooling heat generated from the magnetron, the case unit being composed of a first case installed at an outer side of the magnetron and a second case which is hermetically engaged to the first case at an outer side of the power supply wherein a heat transfer preventing frame is formed between an inside of the second case and an outside of the power supply for shielding heat transmitted from the magnetron.

6. The apparatus of claim 2, wherein the heat transfer preventing plate and a heat transfer preventing frame are formed of plastic material in order to reduce heat transmittance.

7. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit having a hermetic shape, including the magnetron and the power supply therein for cooling heat generated from the magnetron, the case unit being composed of a first case installed at an outer side of the magnetron and a second case which is hermetically engaged to the first case at an outer side of the power supply, wherein an adiabatic member is installed between the first case and the second case for preventing heat generated from the magnetron from being transmitted to the power supply.

8. The apparatus of claim 7, further comprising case ribs which are inwardly formed at opposite surfaces of the first and second cases contacted to the adiabatic member, engaging holes are formed at the case ribs, through holes are formed at the adiabatic member, and the engaging holes and the through holes are coupled by engaging bolts to couple the first and second cases.

9. The apparatus of claim 7, further comprising case ribs which are outwardly formed at opposite surfaces of the first and second cases contacted to the adiabatic member, engaging holes are formed at the case ribs, through holes are formed at the adiabatic member, and the engaging holes and the through hole are coupled by engaging bolts to couple the first and second cases.

10. The apparatus of claim 7, further comprising a sealing plate of rubber which is attached to both sides of the adiabatic member for being closely contacted to the first case and the second case.

11. The apparatus of claim 7, wherein the adiabatic member is formed of stainless having a low heat conductivity.

12. The apparatus of claim 7, wherein the adiabatic member has a constant groove at a center upper portion in order to contain the bulb motor therein.

13. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit, having a hermetic space including the magnetron and the power supply therein for cooling heat generated from the magnetron, the case unit being composed of a first case installed at an outer side of the magnetron and a second case which is hermetically engaged to the first case at an outer side of the power supply wherein a cover for opening and closing the case is provided at upper portions of the first case and the second case, and an adiabatic member is attached to lower edges of the cover where the case and the cover is contacted.

14. A cooling apparatus of a plasma lighting system comprising:

a power supply for supplying a power source;

a magnetron for generating electromagnetic wave by the power source from the power supply;

a bulb for generating light in accordance with that inert gas is ionized by the electromagnetic wave; and a case unit, having a hermetic space, including the magnetron and the power supply therein for cooling heat generated from the magnetron wherein a bulb heat shielding plate of dielectric is provided at a lower side of the bulb in order to minimize heat generated from the light emitting portion of the bulb being transmitted to an inside of the case.

15. The apparatus of claim 14, wherein the bulb heat shielding plate is formed of quartz or alumina.

* * * * *